United States Patent [19]

Jonsson

[11] 4,208,171

[45] Jun. 17, 1980

[54] HYDRODYNAMIC PUMP UNITS AND REGULATORS THEREFOR

[75] Inventor: Arne F. Jonsson, Sodertalje, Sweden

[73] Assignee: Pumpex Production AB, Bandhagen, Sweden

[21] Appl. No.: 785,107

[22] Filed: Apr. 6, 1977

[30] Foreign Application Priority Data

| | | | |
|---|---|---|---|
| Apr. 9, 1976 | [SE] | Sweden | 7604234 |
| May 24, 1976 | [SE] | Sweden | 7605875 |
| May 26, 1976 | [SE] | Sweden | 7605994 |

[51] Int. Cl.[2] ..... F04B 49/00; F04B 49/04

[52] U.S. Cl. ..... 417/15; 60/337; 417/24; 417/40; 417/368; 417/370

[58] Field of Search ..... 417/22, 23, 24, 47, 417/38, 40, 45, 15, 366, 18, 368, 369, 370; 60/330, 337

[56] References Cited

U.S. PATENT DOCUMENTS

| | | | |
|---|---|---|---|
| 2,042,374 | 5/1936 | Wunsch et al. | 417/18 X |
| 2,317,135 | 4/1943 | Crittenden et al. | 417/15 |
| 2,361,086 | 10/1944 | Carlson | 417/15 |
| 2,425,885 | 8/1947 | Jennings | 417/47 |
| 3,072,058 | 1/1963 | Christopher et al. | 417/2 X |
| 3,163,790 | 12/1964 | White | 417/366 |
| 3,285,181 | 11/1966 | Howard | 417/38 X |
| 3,306,219 | 2/1967 | Englesson | 417/366 |
| 3,318,253 | 5/1967 | Campolong | 417/367 |
| 3,371,613 | 3/1968 | Dahlgren et al. | 417/368 |
| 3,424,090 | 1/1969 | Hyde | 417/36 |
| 3,644,067 | 2/1972 | Yowell | 417/370 |
| 3,751,185 | 8/1973 | Gottliebson et al. | 417/36 X |
| 3,800,205 | 3/1974 | Zalar | 417/36 X |
| 3,951,242 | 4/1976 | Fischer et al. | 60/337 X |
| 3,999,385 | 12/1976 | Hoeller et al. | 60/337 X |
| 4,013,384 | 3/1977 | Oikawa | 417/370 X |

*Primary Examiner*—Carlton R. Croyle
*Assistant Examiner*—Edward Look
*Attorney, Agent, or Firm*—L. Lawton Rogers, III

[57] ABSTRACT

A fluid pumping system includes a pump driven at a variable speed by a motor connected to the pump by a fluid cooled transducer. A regulator, connected to the transducer, controls, the speed of the pump responsive to an analog signal related in value to the flow rate of the pump and responsive to a control signal provided by a pump cycle controller. The pump cycle controller senses the level of a basin of fluid to be pumped and provides the control signal. The control signal is operative to start the pump when the fluid level reaches a predetermined starting level, to vary the pump speed responsive to changes in fluid levels higher than the starting level, and to run the pump at a minimum speed when the fluid level is between the starting level and a predetermined stopping level, lower than the starting level.

39 Claims, 18 Drawing Figures

FIG. 1
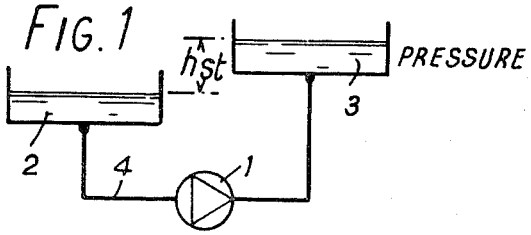
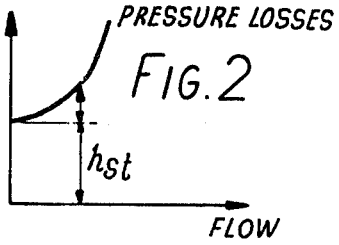
FIG. 2
FIG. 3
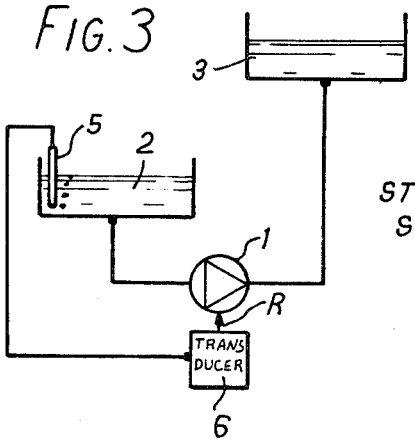
FIG. 4
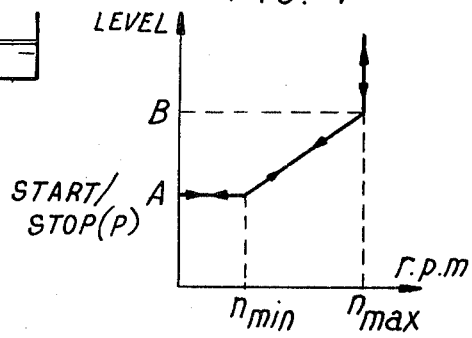
FIG. 5
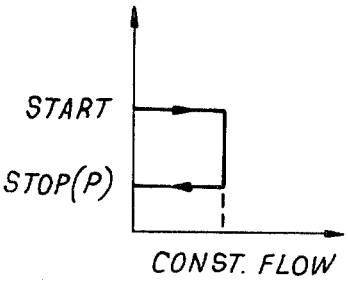
FIG. 6
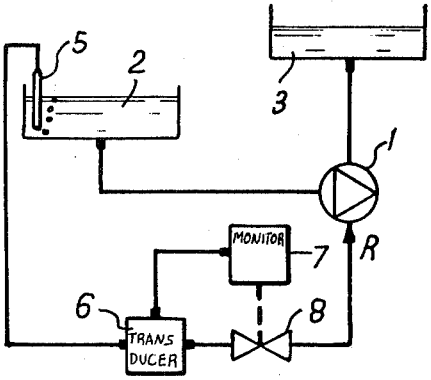

123
128
127
204
129
97
130
93a
96b
93
96a
94
131
112
126
202
203
92

123
120
97
137
134a
116
132
134
133a
133
135
136a
119
135a
136
118
112
126

123
116
141
119
118
140
142
93
139
138
143
94

HYDRODYNAMIC PUMP UNITS AND REGULATORS THEREFOR

BACKGROUND AND OBJECTS OF THE INVENTION

This invention relates to hydrodynamic pump units and to regulators therefor.

In a first aspect, the invention is concerned with a method of driving at least one rotary hydrodynamic pump unit which is controllable so as to give a continuously variable pump performance in dependence on a variable set quantity sensed by at least one sensor system, the control signals of which are supplied to the signal input of of the pump unit.

The invention also relates to a device for performing said method.

By using pump units with a variable performance, considerable savings are achieved when building reservoirs or basins for accommodating flow variations, for instance pumping stations for the disposal of waste water, since reservoirs of smaller volume may be built. Increased inflow is matched by increased pump performance and no account needs to be taken of unpredictable inflow volumes.

Usually variable flow pump units take the form of variable speed (rpm) pump units, but for instance in connection with this invention, basically other forms are also possible, such as units having impellers of variable angles of incidence.

Known methods and devices are based on the principle that, within the desired control range, some quantity of the pump system, for instance the flow of the pump (thus in many cases the pump speed), is proportional to another quantity, for instance the liquid level in the reservoir. When a predetermined minimum value of the set quantity, for instance the level, has been reached, a control signal initiates the increase in the pump performance, and when the set quantity begins to fall, the pump performance is decreased. It is also known to use two or more pumps, the other pump being brought into action when the first pump has reached its maximum performance, and the level still continues to increase. After the second pump has been brought into action, the performances of the two pumps are first mutually balanced, and then they are allowed to increase simultaneously. Both for single pump operation and for multi-pump operation, the aim is to provide flow which is proportional to the variations in the level or volume of liquid in the reservoir.

Moreover, in two-pump installations, it is known to bring the first and the second pump into action alternately, in order to equalise wear in the two pump units. The performance of a pump or the pumps is controlled according to variations in the level or the volume of the liquid. A sensor of the liquid volume in the reservoir is frequently used, in the form of a so-called bubble pipe in which the gas pressure required to cause a gas, e.g. air, to bubble out of the mouth of the pipe, submerged in the liquid, is a measure of the level and, for a reservoir of known dimensions, also a measure of the total liquid volume. However, in connection with the present invention, any other sensor of known type may also be used, which permits the determination of the actual liquid volume in any reservoir, either directly or indirectly, e.g. by using known methods to measure the liquid pressure at a predetermined location or by determining the position of the level in known manner, e.g. by means of photoelements.

With a view to enabling the size of reservoirs to be reduced and also in order to derive certain other benefits, e.g. in the case of storage reservoirs the cancelling-out to a large extent of flow variations (e.g. by maintaining a predetermined ratio between the flow and the stored volume), there is provided, in accordance with the invention in the said first aspect thereof, a method of operating at least one rotary hydrodynamic pump unit which is controllable so as to give a continuously variable pump performance in dependence on a variable set quantity, sensed by at least one sensor system, the control signals of which are supplied to the signal input of the pump unit, wherein the said at least one pump unit is operated according to a discontinuous control cycle according to which at the instant of the start of the cycle, when the set quantity has reached a predetermined start value, the pump unit is started and the sensor system is disconnected from the signal input to the pump unit, and at the instant of the end of the cycle, which corresponds to a predetermined stop value, at which the pump unit is ready for the start of a new cycle, the sensor system is reconnected to the signal input to the pump unit and the pump unit is stopped, the control signal at the signal input being maintained constant during the entire disconnection period at the value at the instant of disconnection, so that during the disconnection period the pump unit is run at constant performance.

By this method, sudden liquid surges in the piping may also be reduced. Basically, in this connection, by the term "set quantity" is meant any desired parameter which is regarded as relevant in any particular case. Apart from the liquid volume (liquid level), this may, for example, be turbidity, concentration of bacteria, etc. In the present case, instead of the actual "set quantity", a quantity dependent thereon may be used, for instance the power consumption of the pump unit, etc., and in the specification and the accompanying claims, the expression "set quantity" should be construed accordingly. Owing to the continuous flow control in combination with constant flow at minimum capacity, the volume of the pump sumps may, if desired, be reduced by a factor of 10. The device according to the invention permits the use of a so-called semi-dry pump installation, which provides better hygienic conditions during maintenance work on the pump, without any increase in construction cost.

Several forms of variable speed pumps are known. In such pumps the speed is controlled with respect to some set value by means of a regulator. The object of the control may be to maintain the pump pressure constant, to maintain the level in an elevated tank constant, to maintain a constant flow, etc. In other cases a quantity in a process may act as a set value. The process quantity may be the temperature of a thermal process, the concentration of some substance in a chemical or biological process, etc. In order to achieve or increase the required stability of a control system, it is moreover known to make the arrangements such that a strong feed-back of the quantity to be controlled is obtained—in this case the pump speed. In that case the pump speed is usually measured electrically (tachometer generator) or in an indirect electrical manner, e.g. by means of photocells and a rotatable disc having black and white fields. When the main purpose of the pump is merely the transfer of liquid, i.e. when the pressure created is incidental, the feed-back of the pump flow rate may be the means of stabilizing the control system. In such a case the flow rate has to be measured hydraulically or electrically, by what is called a dp-cell, in the form of the pressure drop in a venturi pipe or in an orifice plate. The flow may also be measured by means of other types of flow meter based, for example, on a magnetic, capacitative or ultrasonic effect.

Certain special cases of control system for rotary, hydrodynamic, variable speed pumps are known. Thus, there exist controlled pump units which automatically adapt their performance to the requirements in such pipe systems in which the requirement is controlled by the opening and closing of valves in desired positions in the pipe system. A specific example of such a pipe system is a system for the distribution of drinking water, where the requirement is controlled by the opening or closing of one or several tap valves. In this connection, the automatic effect is obtained from a control system having a piston which firstly senses the pressure drop across a minor restriction—i.e. a quantity proportional to the square of the flow—and which secondly is biased by a force from a weight or a spring, this force corresponding to the static head of the pump system, i.e. the sum of the differences in geodetic head and pressure head between the locations between which the liquid is transferred. Since measurement of the liquid flow of sufficient accuracy in a flowmeter is very expensive or may, in practice, be impossible to perform due to pollution of the liquid, electronic systems using what is called indirect measurement have been designed where the pump speed is measured electrically, whereafter the square of the signal is obtained electronically and thereafter electronically reduced by a term corresponding to the static head of the pump system. The signal obtained in this way is then at least approximately proportional to the square of the flow. The signal is then used for feed-back in the control system.

With a view to refining the feed-back link with indirect measurement and thereby also reducing the cost of such systems, the invention, in a second aspect thereof, provides a regulator for a rotary hydrodynamic liquid pump unit and for controlling the speed of the unit, wherein, when the regulator is in use, a speed signal is converted into a signal proportional to the flow rate of the pump or to a signal varying to an even greater extent with the flow rate, by obtaining the square root or roots of higher power from a quantity A' which is proportional to the square of the speed reduced by an adjustable ratio between the static head of the pump system and the pump head at zero flow, and the signal obtained in this way is fed back with respect to the set quantity of the regulator.

Some pump units of the rotary hydrodynamic type for pumping liquids comprise a pump, a driving motor and a transducer connected thereto for obtaining a variable speed. On its input side, the said transducer is driven mechanically or electromagnetically.

The speed transducer associated with the pump unit provides a significant reduction in the initial costs and also in the operating costs of the complete pump unit. Several types of such transducer are known, but the costs involved are usually so high that the transducer can be justified by the said reduction in costs only in rare cases.

In the present application the term transducer also includes such driving motors, preferably asynchronous motors which, by means of special devices, are adapted to permit operation at variable speed.

Typically, known speed transducers are technically far from satisfactory. Thus, power losses of 5 to 80% of the power supplied are frequently recorded. The power losses are converted into heat and have to be dissipated to the environment. For this purpose it has been known to provide a speed transducer with cooling fins for air cooling or with separately mounted external air or liquid cooled radiators.

In some other cases the pumped liquid is permitted to pass through an external, separately mounted radiator in order to recover the heat which has been dissipated. When the pump and the transducer are in the form of an integral unit, it is certainly possible to use external radiators as described but the latter have then to be designed according to the characteristics of the liquid, complex and expensive radiator designs being required when polluted liquids or chemically aggressive liquids, such as waste water or acids are pumped.

With a view to eliminating these last-mentioned disadvantages by providing a pump unit of the kind specified at substantially reduced production costs, the invention, in a third aspect thereof, provides a pump unit of the rotary hydrodynamic type for pumping liquids and comprising a pump, a driving motor and a transducer connected thereto for obtaining a variable speed, said transducer being, on its input side, arranged to be driven mechanically or electromagnetically, wherein, when the unit is in use, a substantial portion of the power losses appearing in the unit in the form of heat is transferred to the liquid being pumped within the unit, at least the pump and the transducer being of integral construction.

The advantages of the invention are achieved due to the fact that the increase in energy supplied to the liquid being pumped by the pump is utilised to reduce the area of the heat transfer surfaces. Thus, it is possible to utilise for the heat transfer the surfaces usually used for encapsulation of the pump and of the transducer. When the transducer is defined by a hydraulic device, the liquid therein can, in accordance with the invention, be used for heat transfer, possibly with the assistance of an auxiliary pump means which is drivable from the shaft of the driving motor or the pump. Moreover, the pressure of the auxiliary pump means may be used for indicating or controlling the value of the variable speed.

In practice it is preferred to provide within the unit at least one surface which is designed for receiving and/or dissipating heat created in the transducer when said heat is transported to the liquid being pumped. At least one surface in the pump and/or in the transducer is designed for transferring heat being dissipated to the liquid being pumped.

In the case where the pump and the transducer are surrounded by, and sealed with respect to, the liquid being pumped, the external surface of the housing may act as a heat-transfer surface to the last-mentioned surface.

A preferred embodiment is characterised in that a member rotatable with the pump motor and/or the transducer is arranged to create a flow of liquid and/or agitation of the liquid in order to promote the transfer to the liquid being pumped of heat to be dissipated.

As has been mentioned above, the transducer may consist of a hydraulic machine or also of a machine arranged for internal lubrication and cooling by means of a liquid providing said liquid flow.

The hydraulic machine may possibly consist of a slipping clutch, possibly of the double-sided hydrodynamic type.

In a preferred arrangement of this kind, the slipping clutch has a continuous through-flow of liquid which is sprayed or thrown against the internal walls of the housing by centrifugal force, the walls being directly or indirectly cooled by the liquid being pumped.

Alternatively, the rotation may be utilised for causing movement of the liquid within a built-in liquid container above the heat-transferring surfaces, which, on their opposite sides, are cooled by the liquid being pumped.

These and other objects and features of the present invention will become apparent from the claims and from the following description when read in conjunction with the appended drawings.

THE DRAWINGS

FIG. 1 shows diagrammatically an example of an installation in which the method and the device embodying the invention are used, FIG. 2 shows a pressure-flow characteristic of the installation of FIG. 1, FIG. 3 shows the installation of FIG. 1 in which a conventional control method is employed, FIG. 4 shows the relationship between the level and the pump speed in the installation of FIG. 3, FIG. 5 shows the relationship between the level and the flow of the pump, whose performance cannot be varied other than by starting and stopping it, FIG. 6 shows the installation of FIG. 1 in which the basic control method according to the invention is employed, FIG. 7 shows the relationship between the level and the speed of the installation of FIG. 6, FIG. 8 is a circuit diagram of a suitable arrangement for providing control according to FIG. 7, FIG. 9 shows the relationship between the level and the speed of a modified control method embodying the invention, FIG. 10 shows the relationship between the level and the speed with two pumps operating in parallel, FIG. 11 shows an installation for providing the control characteristic of FIG. 10, FIG. 12 is a circuit diagram relating to two pumps operating in parallel according to a somewhat modified control characteristic, FIG. 13 is a diagrammatic drawing showing a regulator, FIG. 14 is a vertical section through a submersible pump unit comprising a pump of the centrifugal type and a transducer integral therewith, the transducer being defined by a hydrodynamic slipping clutch, FIG. 15 is a drawing indicating the principle and showing a pump without a pump housing and the associated driving means defined by an asynchronous motor acting as a transducer, FIG. 16 shows a modified pump unit together with its transducer, said transducer being of the "wet-clutch" type, i.e. an oil friction clutch.

FIG. 17 is a diagram indicating the principle and showing a transducer having a cooling housing and an indirect cooling system having an auxiliary pump disposed at the shaft sealing assembly, and FIG. 18 is a schematic block diagram of a controlled pumping system embodiment of the present invention.

DETAILED DESCRIPTION

Figure 7:
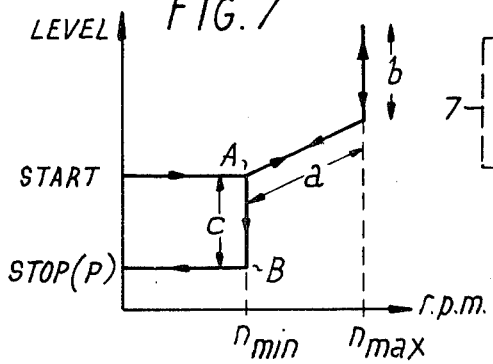

Referring to FIG. 1, a pump 1 is intended to pump a fluid, e.g. waste water, from a basin 2 to a basin 3 located at a higher level than the basin 2. The difference in level between the fluid surfaces in the two basins is assumed to be $h_{st}$ (meters) at a particular instant in time. It is further assumed that the pump is of the rotary hydrodynamic type, i.e. that the pump head decreases with increased rate of discharge (=volume displaced), which is variable by, for example, varying the pump speed, the supply voltage or some other variable. Examples of such pumps are, for instance, centrifugal pumps, axial flow pumps, etc., as opposed to displacement pumps in which the pump head is practically independent of the discharge rate. For the pump 1 to be able to pump fluid from the basin 2 to the basin 3 at all, the pump head must be higher than the static head ($h_{st}$). Moreover, friction losses occur in the pipes 4 to and from the pump, which are small when the discharge is small, but which increase (in accordance with a square law) as the discharge increases. The relationship between the discharge and the pump head of the installation of FIG. 1 is called the system characteristic and is shown in FIG. 2.

Suppose that a fluid flows into the basin 2 of FIG. 3 at a constant or variable rate, and suppose that it is desired to maintain the level in the basin 2 substantially constant. Then, in accordance with a previously known and commonly used method, a level sensor 5, for instance a conventional bubble pipe, is placed in the basin 2, said bubble pipe supplying an electrical signal proportional to the level. (The bubble pipe senses the static head of the fluid which is converted into an electrical signal in a conventional transducer device 6). The electrical signal called the control signal, is permitted continuously to control the pump speed in such a manner that when the set quantity reaches a value corresponding to the desired level, the pump 1 is started at a predetermined minimum speed $n_{min}$, shown in FIG. 4. Successively, as the set quantity increases (=increase in the level in the basin), the speed increases. If the level continues to rise, the speed will increase progressively until the maximum value is obtained (point B in FIG. 4 whereafter the pump runs at the maximum speed even if the level continues to rise. When the basin is being emptied and the level falls, the speed progressively decreases, until the desired level is obtained and the pump is switched off (=when the speed thereof is $n_{min}$). The control is then carried out in accordance with FIG. 4. The disadvantage of this system resides in the large number of starts and stops at levels close to the desired constant level (indicated at A in FIG. 4). Such frequent starts and stops cause wear of the pump contacts. Therefore, in order to reduce this disadvantage, it is common to provide for the basin 2 to have a large surface, so that the control will be less level-sensitive. In a case where a pump cannot be controlled otherwise than by starting and stopping, the relationship between the level and the flow rate is that shown in FIG. 5, from which it is evident that the pump starts at a level "START" and, after having been energised, continuously supplies fluid flow at a constant, invariable, flow rate, until it stops at a lower level "STOP".

The same disadvantage of the control mode according to FIG. 4 also applies to the control mode according to FIG. 5, unless the surface of the basin is made very large.

Figure 8:
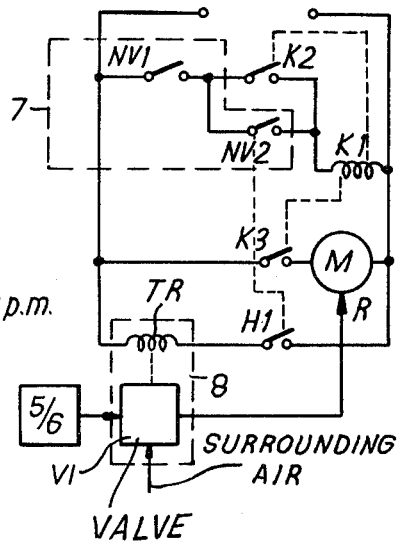

This disadvantage may be eliminated completely by the method and the device according to the present invention. Reference is made to FIGS. 6 and 7. The installation is the same as that in FIG. 3, except for the addition of a device 7 for monitoring the output signal of the transducer device, and a device 8 for the control of the control signal. The details of the monitoring device 7 and the control device 8 are illustrated in FIG. 8. In the same manner as in FIG. 2, the pump 1 starts at a speed $n_{min}$ when the level signal from the bubble sensor 5 assumes a predetermined value.

If the level continues to rise, the speed increases according to the section a of the curve in FIG. 7. If the flow rate into the basin 2 increases substantially, the pump is, just as in the case of FIG. 4, not able to cope with evacuating the basin, even though it is running at maximum speed. The level rises and the pump operates in the region b of the curve in FIG. 7. In due course the level falls and the control signal is reduced to the same extent (according to the section a of the curve in FIG. 7). During the sections a and b, the control signal is monitored by the device 7, and the pump is controlled by the transducer 6. When the control signal assumes a predetermined first value, which for instance corresponds to the desired level in the basin 2, the device 7 is activated. Thereby the transducer 6 is disconnected from the control input R of the pump and instead a device 8 is connected, which supplies a fixed and constant output signal, the magnitude of which is equal to the magnitude of the control signal at the instant when the transducer 6 was disconnected. Thus, the pump will continue to pump at the speed $n_{min}$ (the section c of the curve in FIG. 7). During the section c, the device 7 continues monitoring the output signal of the level sensor, and when said signal has reached a predetermined second value, which for instance corresponds to a level somewhat below the desired level in the basin 2, the pump is disconnected whilst running at its minimum speed.

Reference is again made to FIG. 7. Suppose that the pump starts at the speed $n_{min}$ when the level signal of the bubble sensor 5 reaches a predetermined value. If the rate of flow into the basin—by contrast with the preceding paragraph—is now insignificant, so that the level begins to fall as soon as the pump starts (section "START"—point A in FIG. 7), the pump will operate at a constant speed $n_{min}$ continuously (section c in FIG. 7), until it stops when the lower level is reached (section "STOP"—point B in FIG. 7). Thanks to this, the basin can be dimensioned according to the flow rate at $n_{min}$, and therefore be made smaller. A circuit diagram illustrating the details of the monitor device 7 and the control device 8 for the current supply and the control of the pump is shown in FIG. 8, where NV 1 and NV 2 are electrical contacts forming the monitor device 7 and operated by the level sensor 5, NV 1 being an off-contact and operated at the level "STOP" in FIG. 7, and NV 2 being an on-contact operated at the level "START" in FIG. 7. K1 is a contactor having contacts K2 and K3. The pump motor is denoted M and the control input thereto is denoted R. H1 is an auxiliary contact of NV 2 which is open when NV 2 is open and closed when NV2 is closed. V1 denotes a magnetic valve forming the control device 8, the solenoid of which is connected in parallel with the transformer TR. V1 is closed when NV 2 is open. When V1 is open, the control input R is supplied from the bubble sensor, whilst, when V1 is closed, R is supplied with a constant voltage corresponding to the air pressure when V1 was closed.

Assuming that the level rises despite the pump being switched on, the operation is as follows: NV 1 closes at the level "STOP" (FIG. 7). However, nothing happens until NV 2 is closed, which occurs when the level "START" has been reached; current flows through the coil of the contactor K1, the contacts K2 and K3 are closed and the motor starts to pump. When NV 2 closes, H1 closes and V1 opens and the control input is supplied directly from the level sensor 5 (section a in FIG. 7). When the level thereafter falls and NV 2 opens (point A), the motor M is still supplied with current due to the latching of the contact K2 of K1. However, V1 is closed and the control input to the motor is now supplied, with the constant control quantity corresponding to the speed $n_{min}$ (section c) until the level has fallen to such an extent that NV 1 also opens, when unlatching takes place (K2 opens) and the motor stops. NV 1 is provided with an auxiliary contact (not shown), which opens the closed V1 when NV 1 opens, and the circuit is thus prepared for a new cycle.

The device 7 may for instance consist of fixed or movable contacts arranged in a manometer of the bubble pipe 5.

Devices other than fixed or movable contacts in a manometer may of course be used instead for the device 7, for instance voltage sensitive relays having hysterisis properties.

Figure 9:
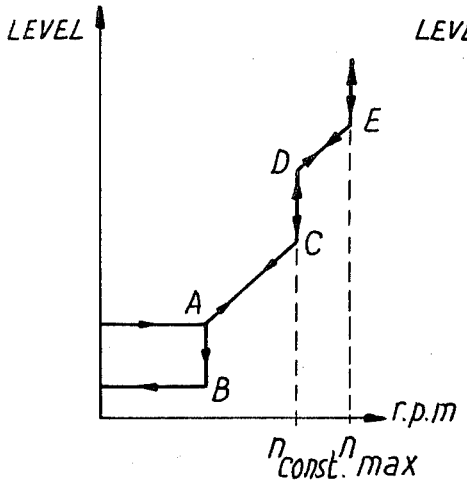

By using either a further device 7, a further bubble pipe 5' (not shown) or a valve having a constant pressure drop equal to the difference in level between D and C, a relationship between level and speed according to FIG. 9 may be obtained. The characteristic feature of this control method will then be the fact that the pump runs at a constant speed within a further level range D-C.

A problem which arises when two pumps, operating in parallel, are used for emptying a basin is that the pump which is sensitive to the levels in the basin which are most common will be switched on and off considerably more frequently than the other pump. In other words, the first pump and its contact means will be subject to heavier wear than the other ones.

Figure 10:
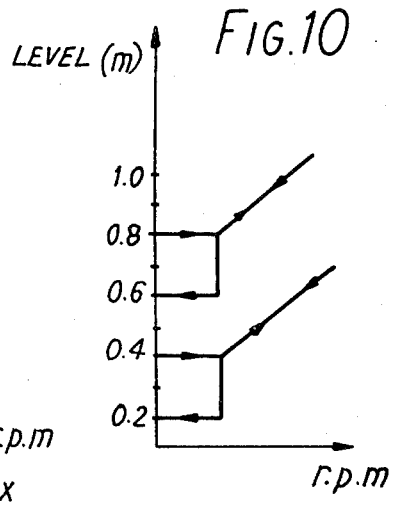

The wear of the pump system will thus become unbalanced, which is disadvantageous, for example from the point of view of maintenance. This disadvantage can be eliminated completely with the control system according to the present invention. In FIG. 10 is shown a desired relationship between the level and the speed of two pumps 1 and 2. Pump 1 starts at a level of 0.4 m at a speed of $n_{min}$, has a continuous speed control from 0.4 to 0.7 m, and runs at constant speed between the levels 0.4–0.2 m, whereafter it stops at a level of 0.2 m at a speed of $n_{min}$. Thus, the control is carried out according to FIG. 6. In the same manner, pump 2 starts at the level 0.8 m, has a continuous speed control between the level 0.8 and 1.1 m, and a constant speed between the levels 0.8–0.6 m and stops at a level of 0.6 m at a speed of $n_{min}$.

Figure 11:
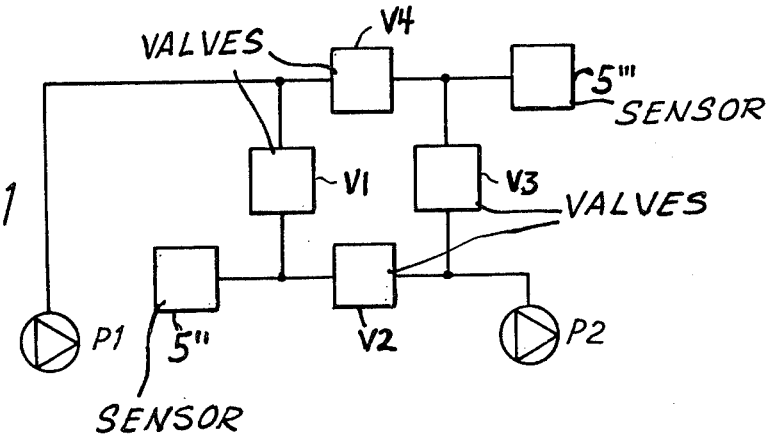

The sensor systems, for instance the bubble sensors 5'' and 5''' of the pumps P1 and P2 in FIG. 11, are interconnected by means of four magnetic valves V1–V4, the operation of which is controlled by stop-start flip-flops, which are activated by the sensor 5'' and 5''' respectively. More precisely, a stop flip-flop for the level 0.2 m, a start flip-flop for the level 0.4 m, a stop flip-flop for the level 0.6 m and a start flip-flop for the level 0.8 m are provided. In the start position it is assumed that V1 and V3 are open, while V2 and V4 are closed. At that instant, P1 is thus controlled by 5″, while P2 is controlled by 5‴. When the level rises above 0.4 m, P1 starts and the characteristic curve of P1 is thus the lowermost of the curves shown in FIG. 10. When, after having risen above 0.4 m, the level falls below 0.4 m, V1 is closed. In the same manner V3 is closed when the characteristic curve of P2 passes through the level 0.8 m.

Alternatively, the following starting conditions are possible: V1 and V3 are closed, V2 and V4 open. P2 is then controlled by 5″ and P1 by 5‴. When the level in the basin passes 0.8 m, V4 is closed and likewise V2 is closed when the level passes 0.4 m.

When the pump which is controlled by 5″ stops upon having reached the level 0.2 m, a conventional so-called alternator (not shown) is activated which reverses the start and stop flip-flops in such a way that V1 is replaced by V4 and V2 by V3. At the moment of alternation, V1–V4 are all closed in accordance with the foregoing.

Thus the function of the stop flip-flop at the level of 0.2 m is to give a signal to the alternator to interrupt the current to the "lowest" pump, i.e. the pump which at that time pumps at the lower one of the two level ranges in accordance with FIG. 10.

The function of the start flip-flop at the level of 0.4 m in the first position of the flip-flop is to supply current to the "lowest" pump and to open V1, or alternatively V2, depending on the position of the alternator. In the second position of the flip-flop V1, or alternatively V2, is to be closed. The purpose of the stop flip-flop at the level of 0.6 m is to disconnect the current supply to the "highest" pump, i.e. the pump which at that moment pumps at the higher of the two levels in accordance with FIG. 10. The purpose of the start flip-flop at the level of 0.8 m is to supply current, in one of its positions, to the "highest" pump and to open V3, or alternatively V4, depending on the position of the alternator. In the other position of the flip-flop, V3, or alternatively V4, is to be closed.

Thanks to the above arrangement, the pumps will firstly wear equally and secondly be started and stopped a limited number of times, as compared with conventional twin-pump operation.

Figure 12:
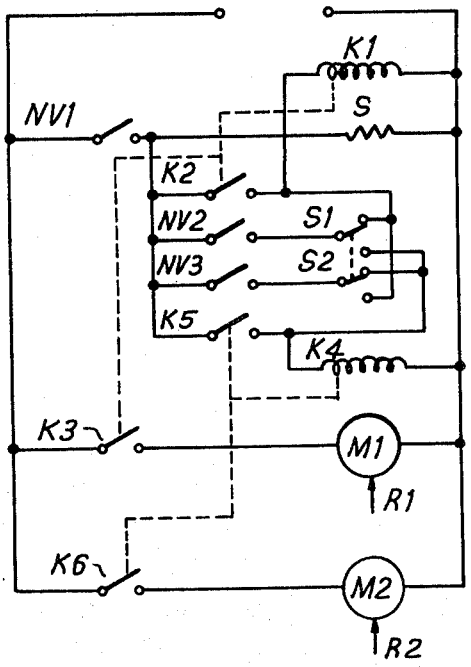

FIG. 12 shows how the electrical connection may be made in a modified embodiment of the invention.

K1 is a contactor for the motor M1 of the pump P1. K1 is provided with auxiliary contacts K2 and K3. Likewise K4 is a contactor for the motor M2 of P2. K4 is provided with auxiliary contacts K5 and K6. The stop flip-flops for the levels of 0.2 m and 0.6 m are integral (in this embodiment) and defined by a common stop flip-flop NV 1 for the two pumps P1 and P2. The stop flip-flop for the level 0.4 m is denoted NV 2 and the start flip-flop for the level 0.8 m is denoted NV3. S denotes the alternator. Thus, in this embodiment P1 and P2 will be disconnected simultaneously and the characteristic curve of the system in FIG. 10 will be altered in that the stop level 0.6 m is lowered to 0.2 m. In the same way as in FIG. 8, V1–V4 are operated by means of auxiliary contacts of NV1, NV2 and NV3. The operation of the device according to FIG. 12 will be apparent to a person skilled in the art and will not be described further.

In all the above embodiments of FIGS. 6, 8, 11 and 12 the magnetic coils have operated a magnetic valve (V1–V4) of such a type that when the valve is closed a constant control quantity is supplied to the control input of the motor concerned, said control quantity corresponding to a constant predetermined speed, whilst when the valve is open, the control input is supplied with a signal directly from the level sensor. Possibly, the air pressure of the bubble pipe can be converted in order to obtain a second constant speed corresponding, for example, to the constant speed $n_{const}$ in FIG. 9.

As described earlier, the level flip-flops may consist of known manometers having fixed or wiping contacts, of pressure switches or of independent level sensor systems, e.g. a bubble pipe or a pressure-bell (known per se).

The auxiliary contacts may, for example, also consist of relays or the like related to the corresponding level switch.

In the above description it has been assumed that at that moment when the sensor system is switched off and the control input of the motor is supplied with a constant quantity, i.e. at the moment when the control signal is, so to speak, frozen at a constant value, this frozen value exactly corresponds to the control signal at the moment of freezing (point A in FIG. 7, points A and D in FIG. 9, respectively). The invention is however not limited to this. On the contrary, the frozen constant value may assume a value distinct from the value of the set quantity at the moment of freezing. The deviation can be fixed or related to some other quantity. Later it has been assumed above that the frozen constant value is immediately, and without any time delay, supplied to the control input of the pump. The invention is not limited to this either and, in suitable cases, a time delay may be introduced between the moment of freezing and the supply of the frozen constant value to the control input of the pump.

The invention in its said second aspect, is characterized by an indirect measurement of the flow, wherein a rotational speed signal is converted so as to be at least approximately proportional to the flow. This important advantage is achieved so that the control system, whilst maintaining its stability, provides constant sensitivity even at low flow rates. For example, in an indirect system involving a signal proportional to the square of the flow, the magnitude of the signal will be only 1% of its maximum value at a flow of 10% of the maximum flow. According to the invention, considerably increased sensitivity is obtained by determining from the square of the flow the square root, or roots of any desired higher power, e.g. the fourth power. Thus, according to the invention, the magnitude of the signal at a 10% flow may, for instance, be 30% of the maximum value of the magnitude of the signal. A further characteristic is that the signal conversion from rpm to flow is performed mechanically or hydromechanically.

The theoretical background of indirect determination of the pumped flow rate will now be explained briefly. The following relationship applies to the displacement of the flow q through a pipe system at a pressure head h:

$$h = h_s + k_1 \times q^2,$$

where $h_s$ is the static head and $k_1$ is a positive constant. At constant speed, the characteristic of a rotary hydrodynamic pump may be expressed approximately by the equation $$H = H_o - k_2 Q^2,$$

where:

H=the pump head at constant speed and at an arbitrary flow rate, $H_O$=the pump head at constant speed and at zero flow rate (viz. the flood point of the pump), Q=the flow rate of the pump at constant speed, $k_2$=a positive constant.

When the value n of the pump speed is variable, the following general relationship is obtained by adapting what is called the affinity laws:

$$h=k_3\times n^2\times H_O-k_4\times q^2,$$

where: h=the pump head at the speed n and the flow rate q q=the flow rate of the pump at the value n of speed, $k_3$ and $k_4$ are positive constants.

At a point of operation the pump head equals the pressure head required of the pipe system, which gives $$h_s+k_1\times q^2=k_3\times n^2\times H_O-k_4\times q^2.$$

Solving for q from the said relationship, the following equation is obtained:

$$q=\sqrt{\frac{H_O}{k_1+k_4}\times\left(k_3n^2-\frac{h_s}{H_O}\right)}=k_5\times\sqrt{k_3n^2-\frac{h_s}{H_O}}=k_5\times A,$$

where $k_5$ is a new constant.

The refinement proposed by the present invention is obtained partly by obtaining the square root or roots of higher power in accordance with the above relationship, partly due to the fact that the negative term $h_s/H$ is settable for different values of the static head $h_2$ with respect to the flood point $H_O$ of the pump, according to the conditions prevailing in any particular pump installation.

Figure 13:
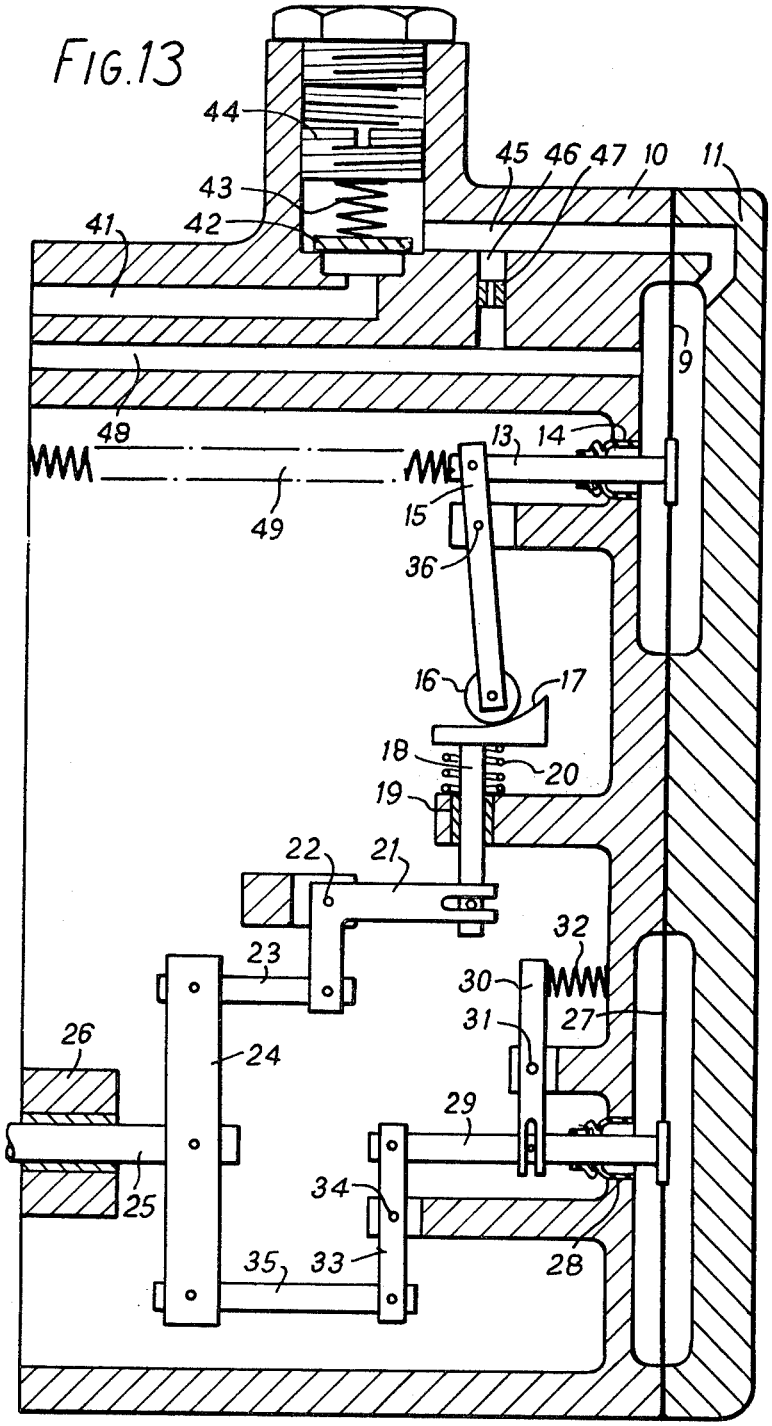

Referring now to FIG. 13, from a speed sensor (not shown) which, for example, can be defined by a small auxiliary pump of the centrifugal type which is connected to the shaft of the main pump, a liquid pressure is obtained which is proportional to the square of the pump speed. This pressure is supplied to an inlet channel 41 and is allowed to act on the lower side (in the drawing) of a valve flap 42. The other side of the flap is biased by a spring 43 whose tension may be adjusted by means of a screw 44. From the valve the liquid flows via a channel 45 through a by-pass conduit 46, provided with a restriction 47 out of the regulator through a discharge conduit 48. The pressure difference between the channels 45 and 48 will be proportional to a quantity A' which in turn is proportional to the square of the speed of the main pump, reduced by a term corresponding to the force biasing the valve flap. This force may be constant, as shown in FIG. 13, but may be controlled externally by means of a cam curve or a hydraulic force.

On a diaphragm 9 or on a bellows sealingly located between a housing 10 and cover 11, the pressure in both the channels 45 and 48 is allowed to act on both sides thereof. The diaphragm is provided with a rod 13 sealed against the housing by means of a bellows 14. The force acting on the rod will be proportional to the quantity A'.

The rod 13 acts on a lever 15 pivotally journalled in the housing at 36. The other end of the lever is provided with a contact element defined by a roller 16 which is journalled in the lever. The roller may operate against a curvature 17 attached to a rod 18 journalled in the housing at 19. The curvature has a profile corresponding to the square root of the quantity A' or some other profile corresponding to roots of higher power. It will be appreciated that any mathematical function which approximates to the said functions may be used. The fact that the rod 18 in the drawing is journalled for vertical movement whilst the roller 16 essentially performs a horizontal movement, i.e. that the movements are perpendicular to each other, is of very great practical importance for reducing the effect of friction. Otherwise there would be a risk of self-restraint even in the "zero position". The movement of the curvature is determined by a force equilibrium between a spring 20 and the force from the diaphragm 9. As an alternative to the bearing 19, the rod 18 may be suspended by two thin steel strips, flexibly and without friction.

The rod 18 is connected to a bell crank lever 21 pivotally journalled in the housing at 22. Via a link 23 a connection to a balance bar 24 may be obtained. The balance bar is pivotally suspended on a rod 25 journalled in the housing at 26, or alternatively flexibly suspended in the same way as the rod 18. At its other end, the rod 25 is connected to a setting means (not shown) for resetting the value of the pump speed. A set quantity—set value—for general control may, for example, be defined by a pneumatic signal obtained from a sensor of, for example, the level in a liquid container. The pneumatic pressure is supplied to the right hand side (in the drawing) of a second diaphragm 27, whilst the left hand side of the diaphragm may be vented to atmosphere. The diaphragm 27 is provided with a rod 29 sealed by means of a bellows 28. The force from the diaphragm 27 is—via a lever 30, pivotally journalled in the housing at 31,—balanced against a spring 32 at the other end of the lever. Via the rod 29, a lever 33, pivotally journalled at 34, and a link 35, movement of the other end of the balance bar 24 may be obtained which is proportional to the pneumatic signal.

Due to the fact that the speed signal converted in the device 9 to 23, 41 to 48 is fed back with respect to the effect of the pneumatic signal, the stability of the regulator is increased. The regulator may be so designed that the pumped flow will be proportional to the pneumatic signal; an instrument indicating the magnitude of the pneumatic signal may be calibrated in terms of flow rate. Thus the system may readily be developed for indicating the volume pumped.

It will be understood that the invention is not limited to the embodiment shown, but that it may, within the scope of the idea underlying the invention, be varied within broad limits. Thus, for instance, the entire regulator or portions thereof may be replaced by electronic components known per se, e.g. for obtaining the root determination necessary for the refined control described. Moreover, the positions of the valve flap and of the restriction may be interchanged, a corresponding pressure being supplied to the diaphragm 9. As an alternative to the hydraulic "subtraction unit" having a valve flap, a spring 49 and a restriction, i.e., a mechanical subtraction unit, may be provided, if the rod 13, in the course of its movement towards the left in FIG. 13, has a constant counteracting force applied thereto, the magnitude of a force being adjustable, e.g. by being biased by a weight or by the spring 49 (having such length that its tension does not vary appreciably as it extends and contracts in the operation of the unit).

Figure 14:
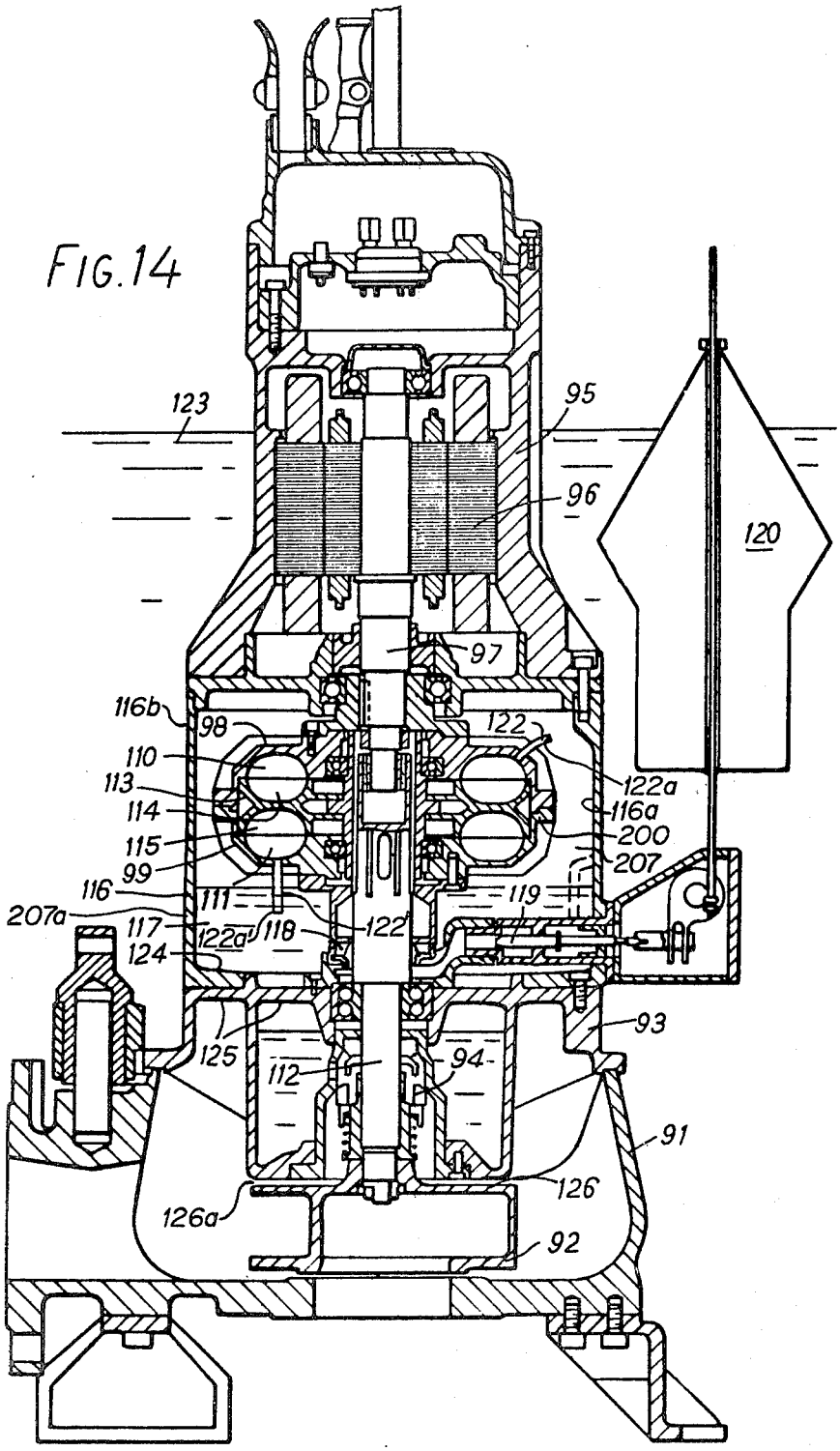

Referring now to FIGS. 14 to 17, the pump unit shown in FIG. 14 comprises a pump of the centrifugal type consisting of a pump housing 91 and a pump impeller 92 covered by a lid 93 comprising a shaft sealing assembly or unit 94. The driving machine of the pump, an asynchronous motor, is denoted by 95 and 96 respectively, and has an output shaft 97. On said shaft a transducer in the form of a double-sided hydrodynamic slipping clutch having an upper member 98 and a lower member 99 is mounted. Said members are linked together and define a transducer casing 200 with a partially hollow interior volume in which transducer, impeller rims 110 and 111 respectively are provided on its internal sides. The pump impeller is arranged on a drive or input shaft 112 which, at the other end thereof, supports a disc 113 transducer impeller rims 114 and 115 respectively being provided on both sides thereof, facing the above-mentioned transducer impeller rims 110 and 111 respectively.

The hydrodynamic slipping clutch is surrounded by a housing 116 having an inner wall face 116*a* and an outer wall face 116*b* and defining a chamber 201 around said clutch. The lower portion of the chamber 201 forms a container 201*a* for a liquid 117. An auxiliary pump means 118 submerged in the liquid in the container 201*a*, is attached to the lower member of the slipping clutch. The liquid is pumped from the container to a regulator valve 119 for the liquid flow, said valve being controlled by a float 120 via a lever system. From the regulator valve the liquid flows to the interior of the transducer casing and the transducer impeller rims 110, 111, 114 and 115 of the slipping clutch. Upon rotation of the slipping clutch members 99 and 98 the motor torque is, in a manner known per se, transmitted to the pump shaft by flow of the liquid in the spaces between the transducer impellers. Owing to the pressure created by the liquid flow, together with the pressure from the auxiliary pump means, the liquid is forced to be discharged through a pipe 122 the mouth 122*a* of which is directed towards the internal wall face 116*a* of the housing 116 in order to spray said face, a relatively thin liquid film being created.

In the embodiment shown, the pump unit is submerged in a volume 123 of the liquid to be pumped so that free suction from said liquid volume is possible. The liquid volume in the slipping clutch, i.e., in the space between the transducer impellers, which volume determines the pump speed, is controlled by the float 120, the regulator valve 119 and the discharge from the pipe 122. The power losses appearing when the clutch slips are transferred to the liquid 117 in the form of heat, which is dissipated from the liquid film on the wall face 116*a* of the housing to said walls, and thence transferred to the pumped liquid 123 surrounding the housing 116.

Alternatively, a pipe 122' may be disposed in the lower member 99 and may extend to have its mouth 122*a'* below the normal level of the liquid 117 in the container 201*a*. Owing to the discharge from the pipe 122' and the simultaneous rotation thereof at the speed of the motor, the liquid 117 is agitated and caused to move in such a way that the required heat transfer is achieved from an interior bottom surface 124 in the chamber 201 whence the heat is supplied to an outer surface 125 past which the pumped liquid flows at a relatively high velocity and therefore has a high heat transfer capacity.

The location of the heat transfer surfaces may be varied considerably. Thus, the surface 125 may be in the form of an annular channel outside the wall of the housing 116 shown, or alternatively the surface 124 may be located above the upper side 126 of the pump impeller. Moreover, for obtaining at least a coarse filtration of the liquid being pumped, said liquid may be tapped off at a certain radius from the centre of the pump shaft, at the narrow gap 126*a* above the upper surface 126 of the pump impeller 92, and may, after cooling the transducer, be returned at a smaller radius, i.e. at lower pressure.

In a further alternative embodiment, the auxiliary pump means is, for the purpose of achieving an increase in velocity past the cooling surfaces, located near the pump shaft, for instance in the shaft sealing unit. Thus it being possible at the same time to supply the pressure from said auxiliary pump means via a bore (not shown) to the outside of the pump unit in order to indicate there, on an instrument known per se, the speed of the pump shaft. Alternatively it may possibly be connected to a conventional comparator which compares the quantity controlled, e.g. the liquid level, and the pump speed.

Figure 15:
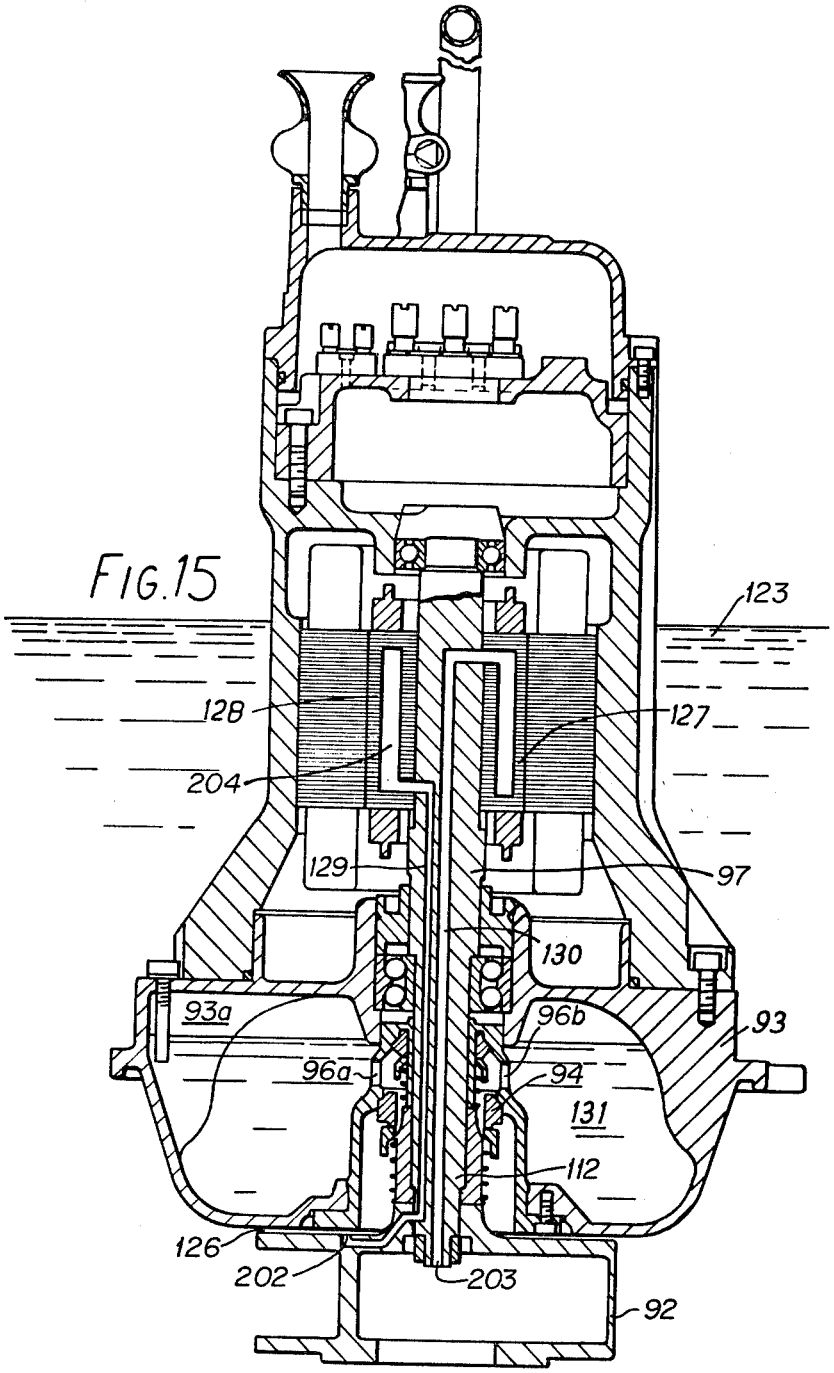

FIG. 15 shows the invention applied to a short-circuited, variable speed, asynchronous motor. The additional losses in the rotor 127 appearing in the case of variation of the effective stator voltage, are transmitted to the liquid being pumped via cylindrical walls 128 of a heat exchanger chamber 204. The liquid flows from an orifice 202 at a location with higher pressure at the upper side 126 of the pump impeller 92, through a channel 129 in the drive shaft 112, into the rotor 127 and back through a channel 130 to an orifice 203 at a location on the suction side of the pump impeller 92. Alternatively, this direct cooling system may be replaced by an indirect system, wherein an auxiliary pump means such as 118 in FIG. 14, e.g. in the shaft sealing unit 94, circulates, via ports or orifices 94*a*, 94*b*, a liquid 131 between a closed container 93*a* and in the cover 93 and to the heat exchanging surfaces 128 in the rotor 127.

Figure 16:
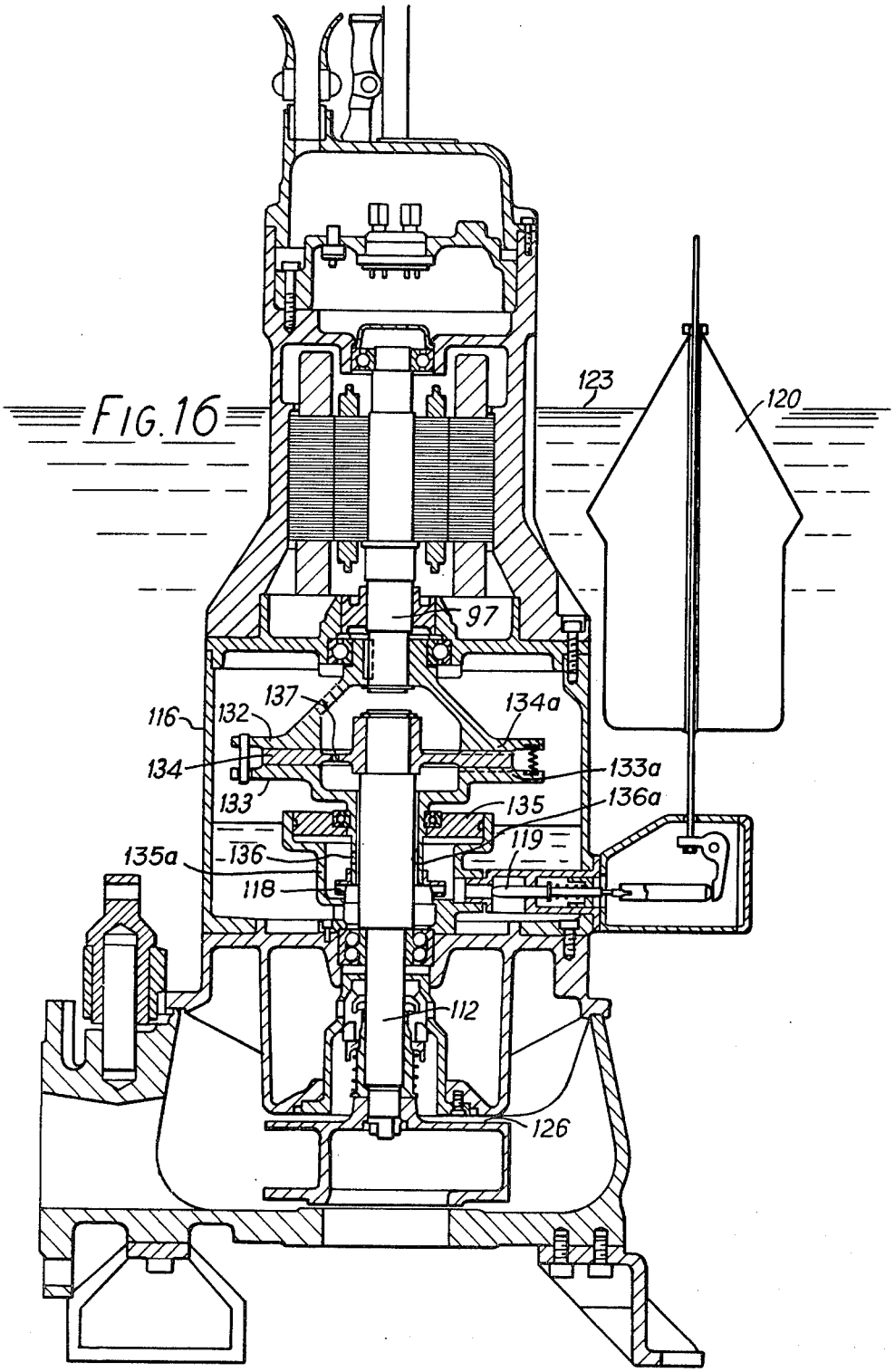

FIG. 16 shows a pump having a liquid friction clutch driven from the motor output shaft 97 and comprising an upper and a lower disc 132 and 133 respectively. The discs 132 and 133 are linked together and define a transducer casing with a partially hollow interior volume. The drive or input shaft 112 of the pump impeller is connected to a disc 134 disposed between said discs. By means of the auxiliary pump means 118, the pressure of which acts on a piston 135 slidable in a cylinder 135*a*, the clutch discs 132 and 133 are pressed together. The pressure of the auxiliary pump is controlled via the float 120 by means of discharge of liquid in the valve 119. The friction heat between the discs 132 and 133 and 134 is cooled by liquid from the auxiliary pump flowing through ports 136 and 137 and an annular passage 136*a* and then out through grooves 133*a*, 134*a* in the discs, wherefrom the liquid is thrown onto the walls of the housing 116. Alternatively, an indirect cooling system may be provided in that the liquid flow from the valve 119 is supplied to a surface disposed above the upper surface 126 of the pump impeller.

Figure 17:
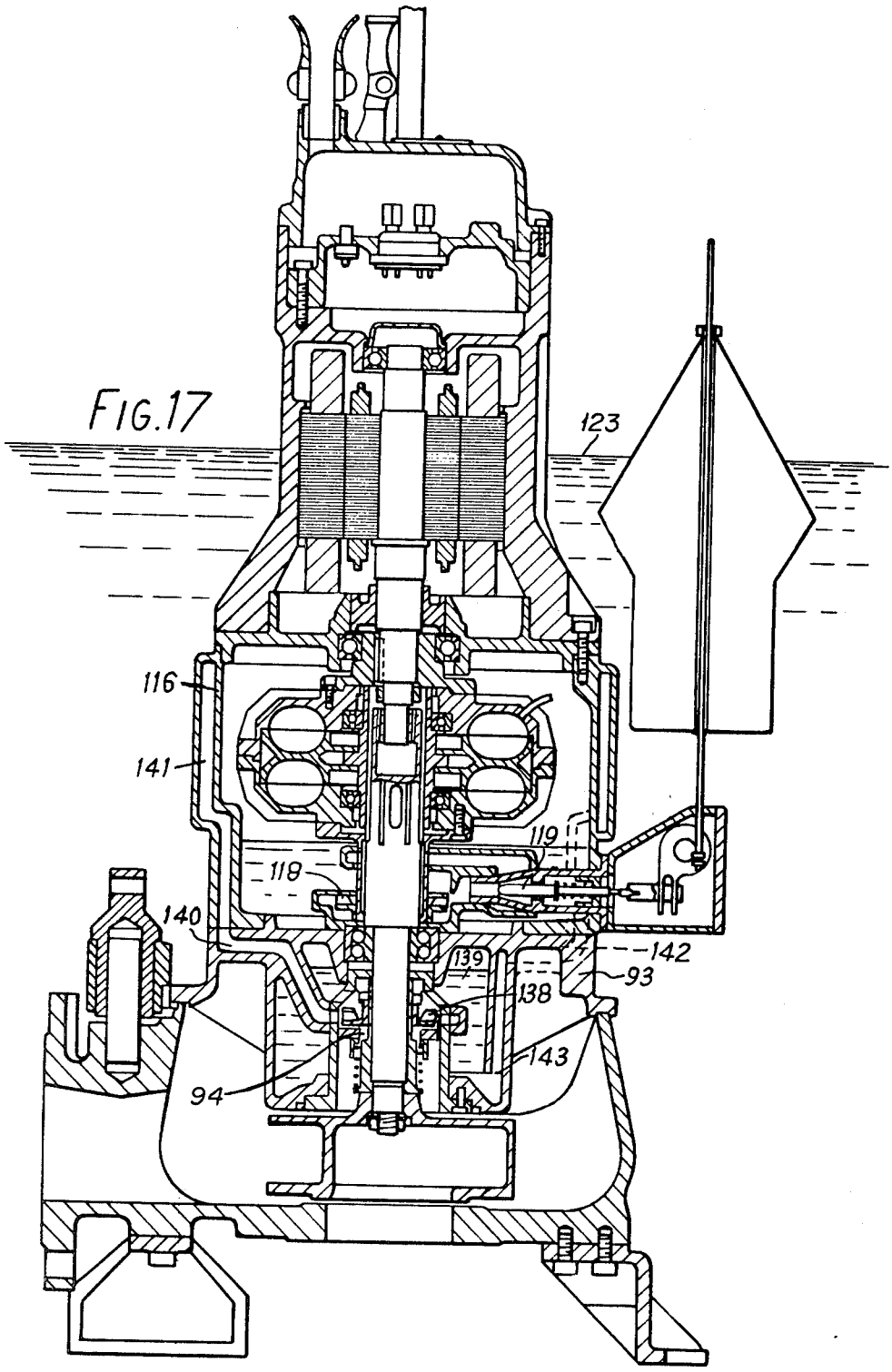

FIG. 17 shows a transducer further having an indirect cooling system comprising a second auxiliary pump means 138 disposed in the shaft sealing unit or assembly 94. A volume of liquid 139 around said unit is pumped through a channel 140 into an annular chamber 141 around the housing 116 and is fed back via a channel 142 to the bottom of the cover 93, where it acquires high discharge velocity in the return flow opening 143. The purpose and operation of the first auxiliary pump means 118 is the same as in the embodiment according to FIG. 14, i.e., in principle, to fill the hydraulic clutch and to dissipate the heat to be dissipated therefrom to the walls of the housing 116, the filling being controlled on the pressure side of the pump by means of the regulator valve 119.

Figure 18:
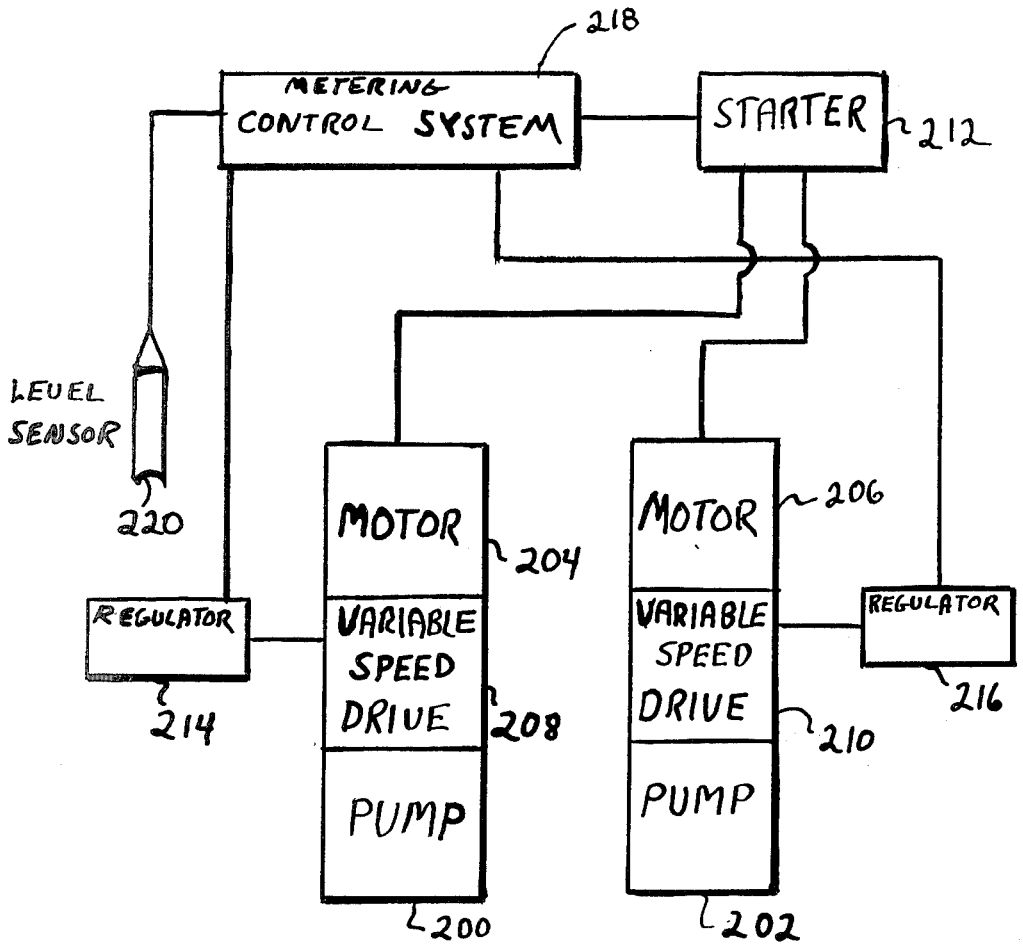

FIG. 18 is a schematic block diagram of a pumping system embodiment of the present invention employing two pumps 200 and 202. The pumps 200 and 202 are coupled to their respective motors 204 and 206 by variable speed drive units 208 and 210 (or transducers) which may be liquid cooled in the manner described above. The motors 204 and 206 may be started by starter 212. The variable speed drive units 208 and 210 may be controlled by regulators 214 and 216, respectively, the regulators being constructed in accordance with the teachings discussed in connection with FIG. 13. The regulators 214 and 216 may be connected to a metering control system 218. The metering control system 218 may receive an input signal from a level sensor 220. The metering control system 218 may control the operation of the pumps in the manner taught in connection with the description of FIGS. 1–12.

The foregoing teachings may be employed to provide a pumping system for variable liquid flows having proportional control of the liquid flows and provision for measuring the liquid flows. The system may be used for pumping of sewage or effluent in wet sump or dry pit installations. The system may include liquid level sensors of bell or air bubble type and an automatic control unit with fluid level and flow recording, said control unit being preadjustable for optional start and stop levels.

The system may include: (1) pump and motor units of the type described above, operable in dry, semi-dry or wet installations; (2) an rpm converter (transducer) with hydrodynamic coupling, such as described above, which insures an extremely high reliability compared to other systems for variable speed control with a range of operation from 30%–100% of the maximum motor rpm; (3) pneumatic liquid level sensors of a ball or air bubble type; (4) a hydraulic-mechanical analogue computer regulator, of the type described above, with built-in feed-back related to the instantaneous pump flow to achieve the high stability in the control system. When the above-described regulator is incorporated in the system a proportional relation is obtained between, e.g., the liquid level in a pump sump and the pump flow. Liquid level indicators built into the control unit may indicate instantaneous flow in percent of maximum flow. As described above, the regulator may be provided with variable presettings of the width of the regulating range and the static head in the system.

The system may be provided with a metering control system such as that described in connection with FIGS. 1–12 to provide, inter alia, start and stop functions at minimum flows; cut-in and cut-out of parallel pumps and stand by pumps; alternate operation of pumps; and means for providing required constant flow at optional preset magnitudes. The aforesaid system has the advantage that it provides substantial energy savings, particularly in pumping systems where the static head is low in relation to the total delivery head. The system may also be operable to partially or completely eliminate shock loads from flow peaks and provide a smooth change over and starting of pumps to prevent pressure and vacuum shocks in the pipe system.

The principles, perferred embodiments and modes of operation of the present invention have been described in the foregoing specification. The invention which is intended to be protected is not, however, to be construed as limited to the particular forms desclosed, since these are to be regarded as illustrative rather than restrictive. Variations and changes may be made by those skilled in the art without departing from the spirit and scope of the present invention.

What is claimed is:

1. A fluid pumping system comprising:

a pump;

a motor for driving said pump;

means for coupling said motor and said pump to drive said pump at variable speeds wherein heat generated by said coupling means and said motor is transferred to the fluid being pumped;

regulator means for controlling said coupling means to vary the speed of said pump responsive to a control signal and responsive to a flow rate signal generated by said regulator means and related in value to the flow rate of the pump, including:

means for providing a pump speed signal related in value to the pump speed;

means for providing a set point signal related in value to a ratio between a static head of the pump and a head of the pump at zero flow; and means for generating the flow rate signal responsive to said first signal and said set-point signal; and a pumping cycle controller including:

means for sensing a fluid level of a body of fluid to be pumped by the system; and means connected to said sensing means for providing the control signal to said regulator to start said pump when the fluid level reaches a predetermined first level, to vary the speed of the pump responsive to changes in the fluid level above the first level, and to operate the pump at a minimum speed when the fluid level is between the first level and a predetermined second level, lower than the first level.

2. In a pumping system including a pump, the speed of which is continuously variable above a minimum speed responsive to a signal applied to a control input thereof, and including a sensor providing a signal related in value to a parameter of a body of liquid to be pumped; an operating cycle comprising the steps of:

applying the sensor signal to the control input of the pump;

starting the pump at the minimum speed responsive to the sensor signal when the parameter of the liquid rises above a first predetermined level;

varying the speed of the pump responsive to the sensor signal while the parameter is greater in value than the first predetermined level;

removing the sensor signal from the control input of the pump when the parameter falls below the first predetermined level;

applying a constant level signal to the control input of the pump to operate the pump at the minimum speed while the parameter is between the first predetermined level and a second predetermined level lower than the first level; and stopping the pump responsive to the sensor signal when the parameter falls to the second predetermined level.

3. The method of claim 2 wherein the parameter is the pressure of the body of liquid.

4. The method of claim 2 wherein the parameter is the level of the body of liquid.

5. In a pumping system including a pump, the speed of which is continuously variable above a minimum speed responsive to a signal applied to a control input thereof, and including a sensor providing a signal related in value to a parameter of a body of liquid to be pumped, said parameter being chosen from the pressure and the level of the body of liquid, an operating cycle comprising the steps of:

applying the sensor signal to the control input of the pump;

starting the pump at the medium speed responsive to the sensor signal when the parameter of the liquid rises above a first predetermined level;

varying the speed of the pump responsive to the sensor signal while the parameter is greater in value than the first predetermined level;

removing the sensor signal from the control input of the pump when the parameter falls below the first predetermined level;

applying a constant level signal to the control input of the pump to operate the pump at the minimum speed while the parameter is between the first predetermined level and a second predetermined level lower than the first level;

stopping the pump responsive to the sensor signal when the parameter falls to the second predetermined level; and when the liquid level reaches a third predetermined level higher than the second level, disconnecting the sensor signal, applying a second constant level signal having the value of the sensor signal at the instant of disconnection to the control input of the pump, and applying a signal related in value to the level of the body of liquid to the control input of the pump when the liquid level rises above a fourth predetermined level, higher than the third level; whereby, during a time interval when the second constant level signal is applied to the control input of the pump, the pump is operated at a constant speed.

6. The method of claim 5 wherein the system includes more than one pump and the pumps are shifted into and out of service during the time interval so that, in the long run, all the pumps operate for substantially the same time.

7. A pumping system comprising:

a pump, the speed of which is variable above a minimum speed responsive to a signal applied to a control input of said pump;

a sensor for providing a sensor signal related in value to a parameter of a body of liquid to be pumped; and switch means for selectively applying the sensor signal to the control input of the pump to start the operation of the pump when said parameter is above a predetermined level and for disconnecting the sensor signal from the control input and applying a constant level signal to the control input responsive to a decrease of the parameter below said predetermined level.

8. The apparatus of 7, wherein the sensor signal is fluidic and wherein said switch means includes a magnetic valve having a first and a second operating position, the valve being arranged to connect the fluidic sensor signal to the control input of the pump, in said first position, and, in said second position, to supply a first predetermined constant fluidic control signal to the control input of the pump.

9. The apparatus of claim 8, wherein said switch means further includes a first switch responsive to the value of said parameter relative to said predetermined level for controlling the position of said magnetic valve, and a second switch connected in series with said first switch and responsive to the value of said parameter relative to a stop level less than said predetermined level for controlling the actuation of said pump.

10. The apparatus of claim 9 further including an electrical relay having a coil connected in series with said first and second switches and a contact connected in parallel with said first switch for maintaining actuation of said pump when said parameter lies between said predetermined level and said stop level.

11. The apparatus of claim 8 further including a second pump and a second valve means for selectively applying a sensor signal or a constant level signal to said second pump in accordance with the value of said parameter relative to a second predetermined level.

12. The apparatus of claim 11 further including third and fourth valve means respectively connected to said pump and said second pump such that said pump is controlled with reference to said second predetermined level and said second pump is controlled with reference to said predetermined level.

13. The apparatus of claim 12 further including a switch for selectively connecting said pump to said valve means and said second pump to said second valve means or connecting said pump to said third valve means and said second pump to said fourth valve means.

14. A regulator for controlling the speed of a rotary hydrodynamic liquid pump which pumps a liquid from a first location to a second location, where a speed signal is converted into a signal related in value to the flow rate of the pump, comprising:

means for providing a pump speed signal related in value to the pump speed;

means providing a set point signal related in value to a ratio between a static head of the pump, defined by the difference in the levels of the liquids at said first and second locations, and the pressure head generated by the pump when no liquid flow takes place between said first and second locations;

means for generating the flow rate signal responsive to a root of the quantity A', wherein A' is proportional to the square of the value of the pump speed signal reduced by the value of the set point signal; and means for applying the flow rate signal to a pump.

15. The regulator of claim 14 wherein, in said generating means, a force proportional to the quantity A' acts on a lever pivotally journalled in a fixed part of the regulator, and the lever is provided with a contacting element for abutment against, and for displacement of, a cam surface having a profile of such shape that the displacement obtained corresponds to a square root determination.

16. The regulator of claim 15 wherein, the displacement obtained by said square root determination is directed substantially perpendicular to the input quantity from which the square root is to be determined.

17. The regulator of claim 16 wherein the contacting element comprises a roller journalled in a bearing.

18. The regulator of claim 14 wherein, the signal related in value to the pump speed is a pressure in a flowing liquid proportional to the square of the pump speed, wherein said pressure, in said generating means, acts on one side of a valve flap, via an inlet channel, wherein said set point signal providing means includes means for adjustably biasing the other side of the flap, and wherein the biased side of the valve flap is connected to a by-pass conduit provided with a restriction and leading to a discharge conduit, whereby the pressure at the biased side of the valve flap becomes proportional to the quantity A', said quantity being defined by the square of the pump speed reduced by a term corresponding to said set point signal.

19. The regulator according to claim 18, wherein a spring is provided to bias said flap.

20. The regulator of claim 18, wherein the pressure at the biased side of the valve flap and the pressure in the discharge conduit act on either side of a flexible element, disposed in a sealed chamber, and the flexible element extends out of the chamber, by means of a flexible sealed rod, whereby the force acting on the said rod becomes proportional to the quantity A'.

21. The regulator of claim 20, wherein said flexible element is in the form of a diaphragm.

22. The regulator of claim 14, wherein the signal related in value to the pump speed is a fluidic signal proportional to the square of the pump speed;

wherein said generating means includes:

a pivotably mounted arm; and a diaphragm means for applying the fluidic signal to an end portion of said arm; and wherein said set point signal providing means includes spring means for applying a force to the end portion of said arm, said force being related in value to the set point in a direction generally opposite to the force applied by the fluidic signal whereby a force proportional to the quantity A' acts on said arm.

23. A pump unit of the rotary hydrodynamic type for pumping liquids, comprising:

a variable speed pump having a drive shaft;

a transducer integral with said pump for controlling the speed of said pump;

means for transporting liquid to and from said transducer such that power losses occurring in said transducer in the form of heat are transferred to the liquid and carried away from said transducer; and auxiliary pump means connected to the drive shaft for supplying the liquid to said transducer to thereby control the speed of said pump, the pressure from said auxiliary pump means being supplied to a comparator which compares the controlled quantity and the pump speed when the pump unit is in use and controls said auxiliary pump means.

24. A rotary hydrodynamic pump unit for pumping liquids, comprising:

a rotary pump having a input drive shaft;

a driving motor having an output drive shaft;

transducer means for operatively connecting said input drive shaft to said output drive shaft and for controlling the speed of rotation of said input drive shaft relative to said output drive shaft, said transducer means including a rotary slipping clutch integrally connected to said motor and said pump by a housing;

means for pumping liquid to said transducer means to control said relative speed of rotation and to absorb heat generated by said transducer means;

means for conducting liquid away from said transducer and directing said liquid towards a heat dissipating surface formed by said housing;

an annular chamber formed by the walls of said housing and located adjacent to said heat dissipating surface;

auxiliary pumping means for pumping liquid to said chamber; and means for conducting liquid from said chamber and into heat dissipating relationship with the liquid being pumped by said rotary pump.

25. A pump unit of the rotary hydrodynamic type for pumping liquids, comprising;

a variable speed pump impeller;

a transducer operatively connected to said pump impeller for controlling the speed of the pump unit; and including at least one heat dissipating wall, and further including a member rotatable with said impeller for transporting liquid into the interior of said transducer and for discharging liquid from said transducer in the form of heat are transferred to the liquid and carried away from said transducer, said wall having one face thereof in contact with the liquid discharged by said transporting and discharging means and another face thereof in contact with the liquid being pumped by the pump unit.

26. The apparatus of claim 25, wherein the liquid flow transfers heat to be dissipated from the transducer to the liquid being pumped.

27. The apparatus of claim 26, wherein the transducer includes a hydraulic system, and, when the unit is in use, the liquid in said system forms the liquid flow.

28. The apparatus of claim 27, wherein the hydraulic system comprises a slipping clutch.

29. The apparatus of claim 28, wherein the slipping clutch is of the hydrodynamic type.

30. The apparatus of claim 29, wherein the hydrodynamic slipping clutch is of the double-sided type.

31. The apparatus of claim 28, wherein the slipping clutch is arranged for a continuous through-flow of liquid, and, when the unit is in use, said liquid is forced against the internal walls of the housing by centrifugal force.

32. The apparatus of claim 26, wherein the transducer includes a means for internally lubricating and cooling the transducer with a liquid, and, when the unit is in use, the liquid in the lubricating and cooling means forms the liquid flow.

33. Apparatus according to claim 32, wherein said transducer includes a variable speed motor, and said means for internally lubricating includes a first fluid conduit for conducting said liquid from said pump to the rotor of said motor, and a second fluid conduit for conducting said fluid from said rotor to said pump.

34. The apparatus of claim 25, wherein at least the pump and the transducer are adapted to be submerged in the liquid being pumped and sealed with respect to said liquid, the arrangement being such that, when the unit is in use, the heat to be dissipated is transferred through a housing encapsulating the unit.

35. A pump unit of the rotary hydrodynamic type for pumping liquids, comprising:

a driving motor with an output shaft;

a pump impeller with a drive shaft;

a transducer with a variable transmission ratio and having a casing with a partially hollow interior volume, said transducer being interposed between said output and drive shafts for driving said impeller, said casing being connected to one of the said shafts for common rotation therewith;

a stationary housing spaced from and sealingly surrounding said transducer and defining a chamber with an inner wall face adjacent the transducer and an outer wall face;

an auxiliary pumping means and conduit means for transporting liquid into said interior volume;

a regulator valve connected to the output port of said auxiliary pumping means for regulating the transmission ratio of said transducer, said valve being adjusted as a function of the level of a volume of a liquid to be pumped by the pump unit; and a discharge means arranged for common rotation with said casing and for discharging liquid from the said interior volume into said chamber.

36. A pump unit of the rotary hydrodynamic type for pumping liquids, comprising;

a driving motor with an output shaft;

a pump impeller with a drive shaft;

a transducer with a variable transmission ratio and having a casing with a partially hollow interior volume, said transducer being interposed between said output and drive shafts for driving said impeller, said casing being connected to one of the said shafts for common rotation therewith, at least a portion of said outer wall face being submerged in a volume of liquid to be pumped by the pump unit and being cooled thereby;

a stationary housing spaced from and sealingly surrounding said transducer and defining a chamber with an inner wall face adjacent the transducer and an outer wall face;

an auxiliary pumping means and conduit means for transporting liquid into said interior volume; and a discharge means arranged for common rotation with said casing and for discharging liquid from the said interior volume into said chamber.

37. A pump unit of the rotary hydrodynamic type for pumping liquids, comprising:

a driving motor with an output shaft;

a pump impeller with a drive shaft;

a transducer with a variable transmission ratio and having a casing with a partially hollow interior volume, said transducer being interposed between said output and drive shafts for driving said impeller, said casing being connected to one of the said shafts for common rotation therewith, said transducer being a liquid friction clutch with a plurality of clutch discs pressed one against the other, and said discharge means having a plurality of grooves in said discs;

a stationary housing spaced from and sealingly surrounding said transducer and defining a chamber with an inner wall face adjacent the transducer and an outer wall face;

an auxiliary pumping means and conduit means for transporting liquid into said interior volume; and a discharge means arranged for common rotation with said casing and for discharging liquid from the said interior volume into said chamber.

38. The pump unit of claim 37, wherein said discharge means is a pipe attached to and protruding from said casing and having a mouth directed towards said inner wall face for spraying the discharged liquid on said face under the influence of the rotation of said casing.

39. The pump unit of claim 37 further including:

piston means mechanically connected to one of said clutch discs; and cylinder means, slidably carrying said piston means and communicating with the output port of said auxiliary pumping means for varying the degree of pressure between said clutch discs in dependence on the pressure acting on said piston means.

* * * * *